US010156406B2

(12) United States Patent
Lee et al.

(10) Patent No.: US 10,156,406 B2
(45) Date of Patent: Dec. 18, 2018

(54) HEAT EXCHANGER

(71) Applicant: LG ELECTRONICS INC., Seoul (KR)

(72) Inventors: Juhyoung Lee, Gyeongsangnam-do (KR); Seongwon Bae, Gyeongsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 443 days.

(21) Appl. No.: 14/582,786

(22) Filed: Dec. 24, 2014

(65) Prior Publication Data

US 2015/0184953 A1 Jul. 2, 2015

(30) Foreign Application Priority Data

Dec. 24, 2013 (KR) ..... 10-2013-0162820

(51) Int. Cl.

| | |
|---|---|
| ***F28F 9/04*** | (2006.01) |
| ***F28F 13/06*** | (2006.01) |
| ***F28F 9/02*** | (2006.01) |
| ***F28D 1/053*** | (2006.01) |
| ***F28F 1/32*** | (2006.01) |

(52) U.S. Cl.

CPC ..... *F28F 13/06* (2013.01); *F28D 1/05341* (2013.01); *F28F 1/32* (2013.01); *F28F 9/0275* (2013.01); *F28F 9/04* (2013.01); *F28F 2009/0285* (2013.01)

(58) Field of Classification Search

CPC ..... F28F 9/0221; F28F 2009/0285
USPC ..... 165/173, 175
See application file for complete search history.

(56) References Cited

U.S. PATENT DOCUMENTS 2,064,036 A 12/1936 Sanderberg
2,085,313 A * 6/1937 Guthrie ..... B21D 53/04 220/4.12
2,930,590 A * 3/1960 Sartori et al. ..... F28D 1/05308 165/129

(Continued)

FOREIGN PATENT DOCUMENTS

| | | |
|---|---|---|
| CN | 1936487 | 3/2007 |
| EP | 2 485 007 A2 | 8/2012 |
| WO | WO 2009/127063 | 10/2009 |

OTHER PUBLICATIONS

European Search Report issued in Application No. 14200051.2 dated Jun. 19, 2015.

(Continued)

*Primary Examiner* — Allen Flanigan
(74) *Attorney, Agent, or Firm* — KED & Associates LLP

(57) ABSTRACT

According to the present invention, a heat exchanger comprises a plurality of coolant tubes and a coolant guide having a coolant flow path through which the plurality of coolant tubes communicate with each other, wherein the coolant guide includes a plurality of plates facing each other, wherein the pair of plates, respectively, include coolant flow path units formed facing each other, the coolant flow path unit forming the coolant flow path, and wherein the pair of plates, respectively, further include joining parts that come in surface contact with each other. Accordingly, the number of parts of the coolant guide may be minimized, and the structure of the heat exchanger may be simplified.

9 Claims, 15 Drawing Sheets

(56) References Cited

U.S. PATENT DOCUMENTS

| | | | | |
|---|---|---|---|---|
| 3,741,849 | A * | 6/1973 | Hardy | B29C 65/04 156/196 |
| 5,524,707 | A * | 6/1996 | Fredrich | F28F 9/162 165/150 |
| 6,467,536 | B1 * | 10/2002 | Abate et al. | F25B 39/02 165/151 |
| 2002/0023740 | A1 * | 2/2002 | Lowenstein et al. | F28D 5/00 165/166 |
| 2002/0074113 | A1 * | 6/2002 | Abell et al. | F28F 9/0214 165/175 |
| 2007/0251682 | A1 | 11/2007 | Sasaki | |
| 2012/0199327 | A1 * | 8/2012 | Gaiser | F28D 1/05341 165/160 |

OTHER PUBLICATIONS

Chinese Office Action dated Jul. 6, 2016 issued in Application No. 201410818069.5 (English translation attached).

* cited by examiner

HEAT EXCHANGER

CROSS-REFERENCE TO RELATED APPLICATION (S)

This application is a claims priority to Korean Patent Application No. 10-2013-0162820, filed Dec. 24, 2013, whose entire disclosure is hereby incporporated by reference.

The present invention relates to a heat exchanger, and particularly, to a heat exchanger having a plurality of coolant tubes.

BACKGROUND

1. Field

In general, heat exchangers are apparatuses for transferring heat between two fluids, and the heat exchangers are widely used for cooling or heating rooms or supplying hot water.

2. Background

A heat exchanger may function as a waste heat recovery heat exchanger for recovering waste heat, a cooler for cooling a fluid on a high-temperature side, a heater for heating a fluid on a low-temperature side, a condenser for condensing a coolant, or an evaporator for evaporating a coolant.

There may be various types of heat exchangers including a fin tube-type heat exchanger having a tube through which a first fluid passes and a fin provided on the tube, a shell tube-type heat exchanger having a shell through which a first fluid passes and a tube through which a second fluid passes to exchange heat with the first fluid, and a plate-type heat exchanger having a first fluid and a second fluid pass through with a plate-shaped heat transfer plate interposed therebetween.

Among the heat exchangers, the fin tube-type heat exchanger may include a plurality of coolant tubes through which a coolant passes to exchange heat with ambient air.

SUMMARY OF THE INVENTION

The present invention aims to provide a heat exchanger with a minimum number of parts and simplified structure and manufacturing process.

To achieve the above objects, according to the present invention, a heat exchanger comprises a plurality of coolant tubes; and a coolant guide having a coolant flow path through which the plurality of coolant tubes communicate with each other, the coolant guide includes a plurality of plates facing each other, the pair of plates, respectively, include coolant flow path units formed facing each other, the coolant flow path unit forming the coolant flow path, and the pair of plates, respectively, further include joining parts that come in surface contact with each other.

The joining parts may be larger in area than the coolant flow path units.

Respective ends of the plurality of coolant tubes may be inserted into a space between the coolant flow path units.

The pair of plates each may include a plurality of joining parts spaced apart from each other, and the coolant flow path units may be convexly protruded between the plurality of joining parts.

The plurality of joining parts may be separated from each other by the coolant flow path units.

The respective coolant flow path units of the pair of plates may be convexly protruded in opposite directions thereof.

The pair of plates may be shaped as a rectangle long in a direction perpendicular to a longitudinal direction of the coolant tubes.

The coolant flow path units each may include a plurality of tube connection parts formed in parallel with each other, the coolant tubes connected with the tube connection parts.

The coolant flow path units each may further include a plurality of common flow path parts spaced apart from the plurality of tube connection parts, the number of the plurality of common flow path parts being smaller than the number of the plurality of tube connection parts, and a connection flow path part connecting the plurality of tube connection parts with the plurality of common flow path parts.

The plurality of common flow path parts may include a first common flow path part and a second common flow path part spaced apart from each other, and an expanded flow path part connected with each of the first common flow path part and the second common flow path part, the expanded flow path part being larger in size than the first common flow path part and the second common flow path part, and the connection flow path part may be connected with the second common flow path part.

The coolant flow path units each may be a return flow path part connecting two coolant tubes with each other, and each of the pair of plates may include a plurality of return flow path parts.

The plurality of return flow path parts may be spaced apart from each other in a longitudinal direction of each of the pair of plates.

The pair of plates and the plurality of coolant tubes may be formed of aluminum.

A plurality of coolant guides may be connected with the plurality of coolant tubes.

To achieve the above objects, according to the present invention, a heat exchanger comprises a front-row heat exchange unit including a plurality of coolant tubes; a rear-row heat exchange unit including a plurality of coolant tubes, air having passed through the front-row heat exchange unit passes through the rear-row heat exchange unit; and a heat exchange unit connector having a coolant flow path through which the front-row heat exchange unit and the rear-row heat exchange unit communicate with each other, the heat exchange unit connector includes an outer connector and an inner connector positioned inside the outer connector and facing the outer connector, the outer connector and the inner connector, respectively, include coolant flow path units formed facing each other, the coolant flow path unit forming the coolant flow path, and the outer connector and the inner connector, respectively, further include joining parts that come in surface contact with each other.

Respective ends of the plurality of coolant tubes may be inserted into a space between the outer connector and the inner connector.

Respective ends of the plurality of coolant tubes may be inserted into a space between the coolant flow path units.

The outer connector and the inner connector each may be shaped as a rectangle long in a direction perpendicular to a longitudinal direction of the coolant tubes, and a plurality of coolant flow path units may be spaced apart from each other in a longitudinal direction of the heat exchange unit connector.

The outer connector and the inner connector each may include a pair of flat plates facing each other and a curved plate connecting the pair of flat plates with each other.

The coolant flow path units each may be continuously formed on one of the pair of flat plates, the curved plate, and the other of the pair of flat plates.

The outer connector, the inner connector, and the plurality of coolant tubes may be formed of aluminum.

The heat exchanger configured as above may have a minimum number of parts and a simplified structure.

Further, the heat exchanger according to the present invention may be easily manufactured by a furnace brazing process.

BRIEF DESCRIPTION OF THE DRAWINGS

The embodiments will be described in detail with reference to the following drawings in which like reference numerals refer to like elements wherein.

DETAILED DESCRIPTION

Hereinafter, a heat exchanger according to an embodiment of the present invention is described with reference to the accompanying drawings.

Figure 1:
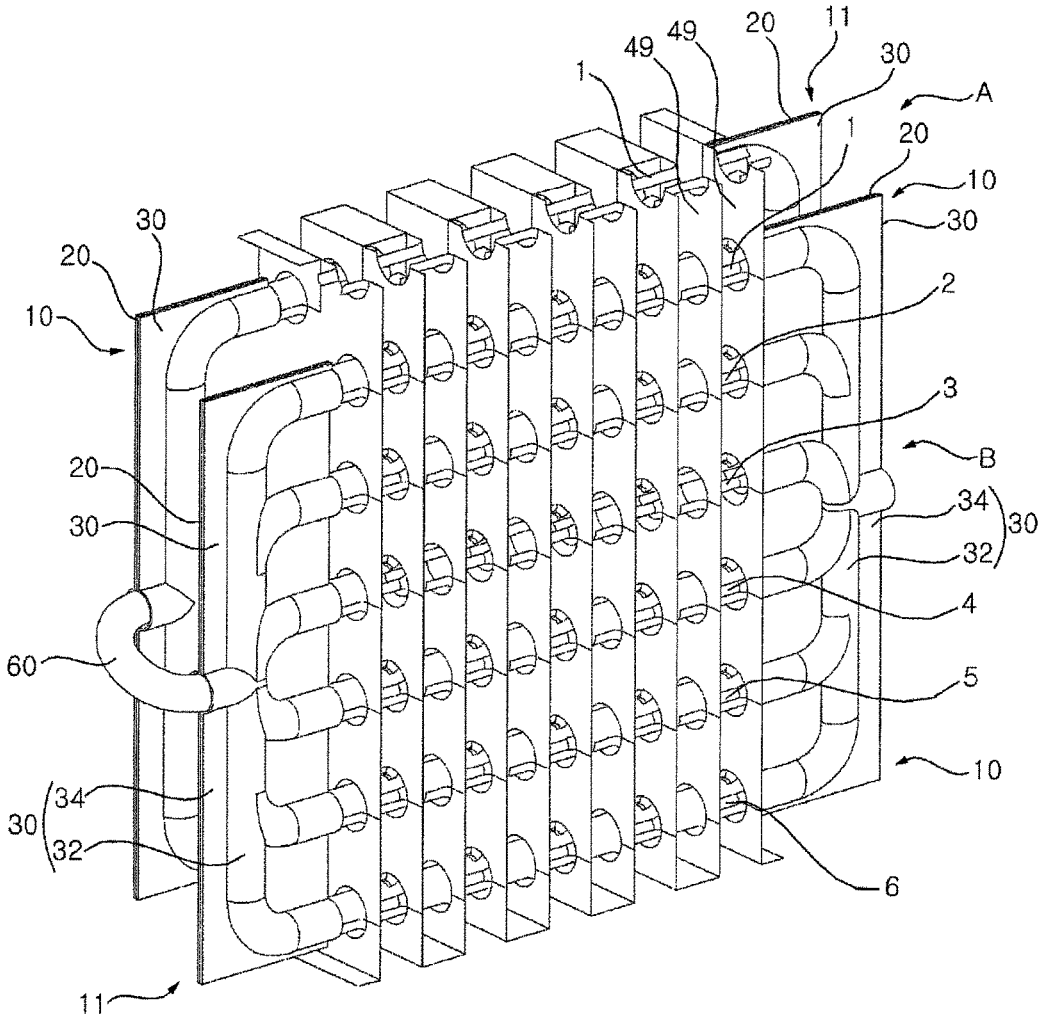
FIG. 1 is a perspective view illustrating a heat exchanger according to a first embodiment of the present invention.
Figure 2:
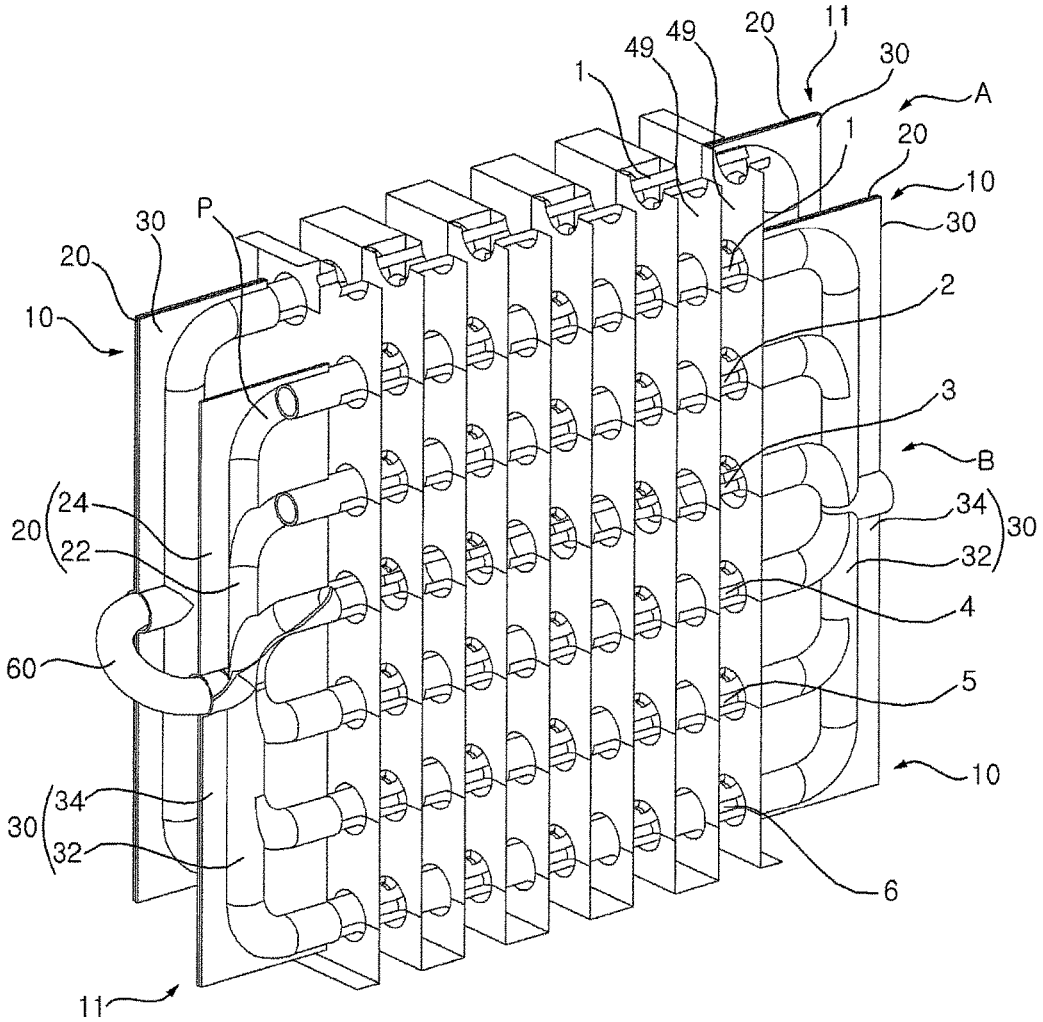
FIG. 2 is a perspective view illustrating a heat exchanger with a portion thereof cut away, according to the first embodiment of the present invention.
Figure 3:
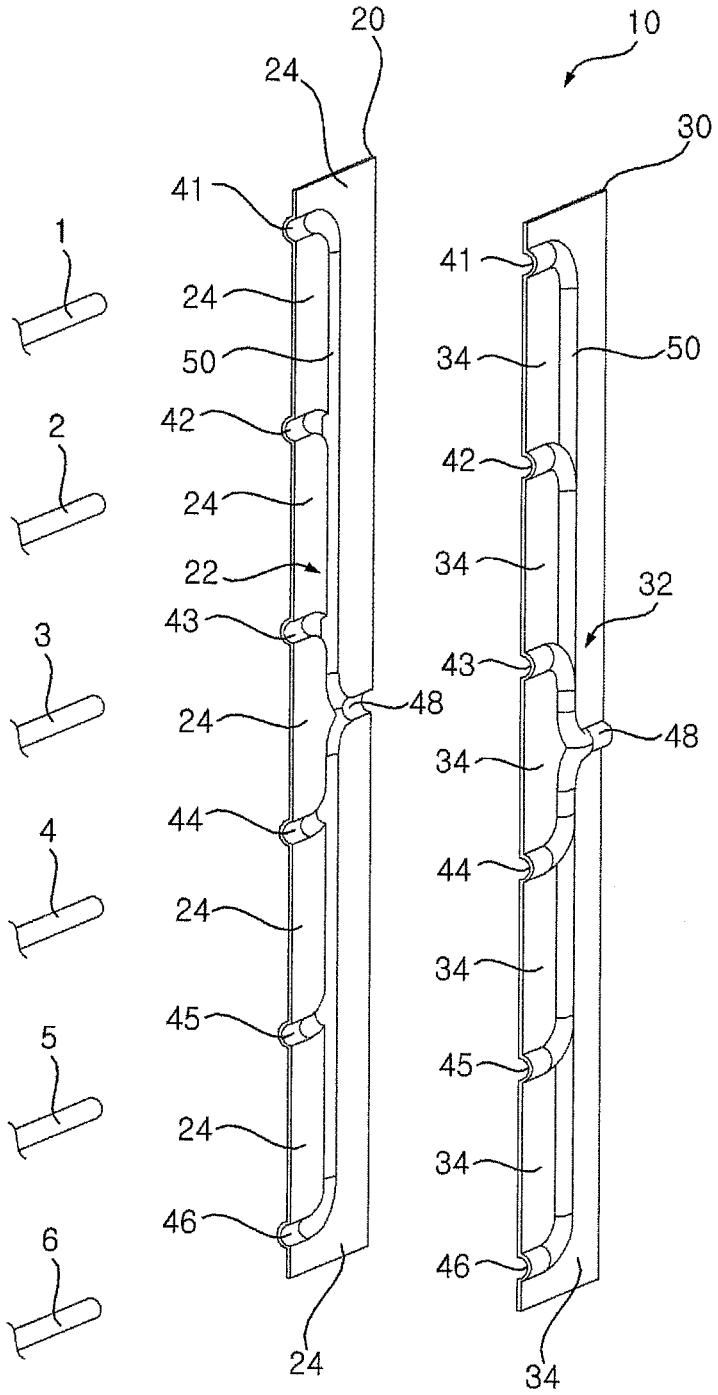
FIG. 3 is an exploded, perspective view illustrating a heat exchanger according to the first embodiment of the present invention.
Figure 4:
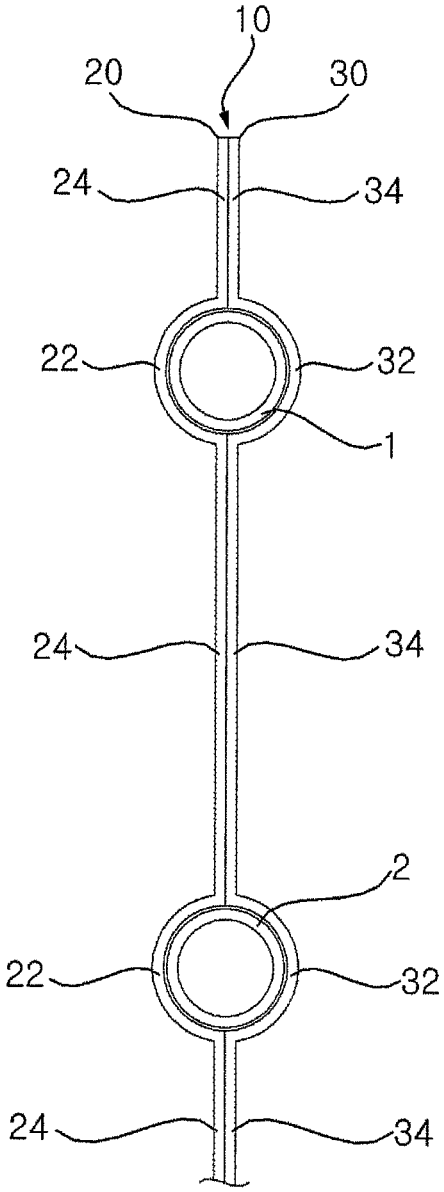
FIG. 4 is a longitudinal sectional view illustrating a coolant guide of a heat exchanger according to the first embodiment of the present invention.
Figure 5:
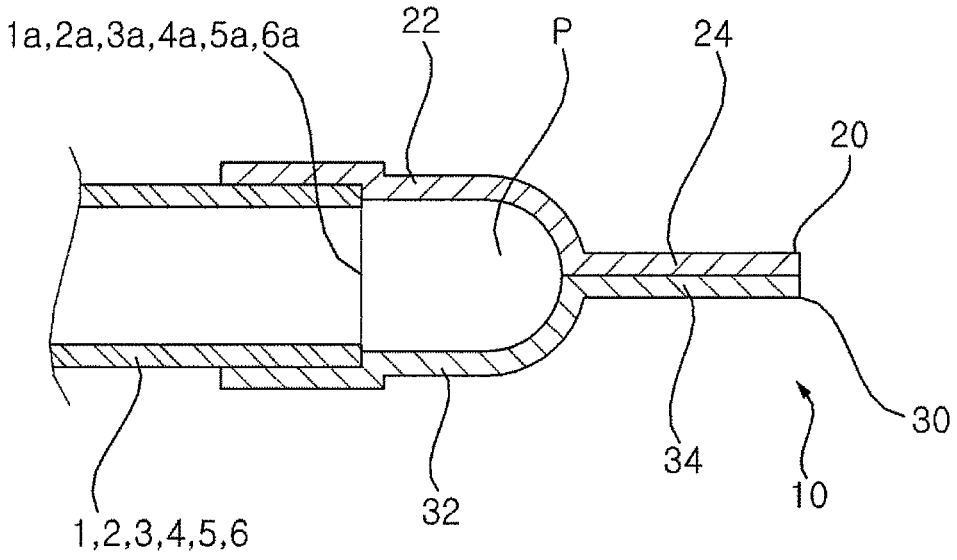
FIG. 5 is a longitudinal sectional view illustrating a coolant guide of a heat exchanger according to the first embodiment of the present invention.

FIG. 1 is a perspective view illustrating a heat exchanger according to a first embodiment of the present invention. FIG. 2 is a perspective view illustrating a heat exchanger with a portion thereof cut away, according to the first embodiment of the present invention. FIG. 3 is an exploded, perspective view illustrating a heat exchanger according to the first embodiment of the present invention. FIG. 4 is a longitudinal sectional view illustrating a coolant guide of a heat exchanger according to the first embodiment of the present invention. FIG. 5 is a longitudinal sectional view illustrating a coolant guide of a heat exchanger according to the first embodiment of the present invention.

According to the instant embodiment, the heat exchanger includes a plurality of coolant tubes 1, 2, 3, 4, 5, and 6, and a coolant guide 10 having a coolant flow path P for communication between the plurality of coolant tubes 1, 2, 3, 4, 5, and 6. The coolant guide 10 includes a plurality of plates 20 and 30. The pair of plates 20 and 30 may face each other. The coolant flow path P is formed between the pair of plates 20 and 30. The pair of plates 20 and 30 of the heat exchanger may have coolant flow paths 22 and 32, respectively, for forming the coolant flow path P. The respective coolant flow path units 22 and 32 of the pair of plates 20 and 30 may face each other. The pair of plates 20 and 30, respectively, have joining parts 24 and 34 that come in surface contact with each other. The joining parts 24 and 34 may be formed at portions of the pair of plates 20 and 30 except the coolant flow path units 22 and 32. The joining parts 24 and 24 may be formed at the overall or partial remaining portions of the pair of plates 20 and 30 except the coolant flow path units 22 and 34. The plate 20 may include the coolant flow path unit 22 and the joining part 24, and the plate 30 may include the coolant flow path unit 32 and the joining part 34. The plate 20 may include the coolant flow path unit 22 and the joining part 24 while the plate 30 may include the coolant flow path unit 32 and the joining part 34, and the pair of plates 20 and 30 may further include a separate non-joining part (not shown) other than the coolant flow path units 22 and 24 and the joining parts 24 and 34. In the pair of plates 20 and 30, the coolant flow path P is formed between the coolant flow path units 22 and 32, with the coolant flow path units 22 and 32 facing each other. In the pair of plates 20 and 30, the joining parts 24 and 42 may be joined to each other, with the joining parts 24 and 34 facing each other.

The plurality of coolant tubes 1, 2, 3, 4, 5, and 6 each may be shaped as a hollow straight pipe. The plurality of coolant tubes 1, 2, 3, 4, 5, and 6 may be connected with the coolant guide 10 in parallel with each other. The plurality of coolant tubes 1, 2, 3, 4, 5, and 6 may be spaced apart from each other in a direction perpendicular to their longitudinal direction. The plurality of coolant tubes 1, 2, 3, 4, 5, and 6 may be connected with the coolant guide 10 to form a single body with the coolant guide 10. The number of the coolant tubes 1, 2, 3, 4, 5, and 6 connected with the coolant guide 10 is not limited, and for example, the number of coolant tubes 1, 2, 3, 4, 5, and 6 may be selected within a range from 4 to 20 or the number thereof may be less than 4 or more than 20.

The plurality of coolant tubes 1, 2, 3, 4, 5, and 6 may be formed of aluminum.

The respective ends 1*a*, 2*a*, 3*a*, 4*a*, 5*a*, and 6*a* of the plurality of coolant tubes 1, 2, 3, 4, 5, and 6 may be inserted into a space between the pair of plates 20 and 30. The respective ends 1 a, 2*a*, 3*a*, 4*a*, 5*a*, and 6*a* of the plurality of coolant tubes 1, 2, 3, 4, 5, and 6 may come in surface contact with each of the pair of plates 20 and 30. The respective ends 1*a*, 2*a*, 3*a*, 4*a*, 5*a*, and 6*a* of the plurality of coolant tubes 1, 2, 3, 4, 5, and 6 may be inserted into the coolant flow path units 22 and 32. The plurality of coolant tubes 1, 2, 3, 4, 5, and 6 may be partially inserted into a space between the pair of plates 20 and 30. A portion of the inserted part may be inserted into the coolant flow path unit 22 of the first plate 20. The remainder of the inserted part may be inserted into the coolant flow path unit 32 of the second plate 30. The part of the coolant tubes 1, 2, 3, 4, 5, and 6 inserted into the coolant guide 10 may, partially in its outer circumferential surface, come in surface contact with the coolant flow path unit 22 of the first plate 20. The part of the coolant tubes 1, 2, 3, 4, 5, and 6 inserted into the coolant guide 10 may, in its remaining outer circumferential surface, come in surface contact with the coolant flow path unit 32 of the second plate 30.

The pair of plates 20 and 30 may be a coolant flow path forming member forming the coolant flow path P through which a coolant passes, or the two plates 20 and 30 may be combined to form the coolant flow path P. A single coolant flow path P or a plurality of coolant flow paths P may be formed between the pair of plates 20 and 30. Each of the pair of plates 20 and 30 may have a plurality of joining parts 24 or 34. The plurality of joining parts 24 and 34 may be formed in the pair of plates 20 and 30 to be spaced apart from each other, and the coolant flow path units 22 and 32 may be protruded between the plurality of joining parts 24 and 34. The joining parts 24 and 34 may be separated from each other by the coolant flow path units 22 and 32. The area of the joining parts 24 and 34 may be larger than the area of the coolant flow path units 22 and 32, and the pair of plates 20 and 30 may be securely joined to each other. The respective coolant flow path units 22 and 32 of the pair of plates 20 and 30 may be curved outwardly in opposite directions thereof. A portion of the coolant flow path unit 22 of the first plate 20 may be shaped to surround a partial outer circumferential surface of the part of the coolant tube 1, 2, 3, 4, 5, or 6 inserted into the coolant guide 10. A portion of the coolant flow path unit 32 of the second plate 30 may be shaped to surround the remaining outer circumferential surface of the part of the coolant tube 2, 2, 3, 4, 5, or 6 inserted into the coolant guide 10. The coolant flow path unit 22 of the first plate 20 may have an inner space that serves as a portion of the coolant flow path P. The coolant flow path unit 32 of the second plate 20 may have an inner space that serves as the remaining portion of the coolant flow path P. The cross section of the coolant flow path units 22 and 32 may be semi-circular in shape. The coolant flow path unit 22 of the first plate 20 and the coolant flow path unit 32 of the second plate 30, when the first plate 20 is joined to the second plate 30, form a circular shape in cross section, and the coolant flow path unit 22 of the first plate 20 and the coolant flow path unit 32 of the second plate 30 may be combined with each other to form a tube unit for guiding a coolant.

The pair of plates 20 and 30 may be brazed to each of the plurality of coolant tubes 1, 2, 3, 4, 5, and 6, and the pair of plates 20 and 30 may be formed of aluminum. The pair of plates 20 and 30 may be formed of the same material as the plurality of coolant tubes 1, 2, 3, 4, 5, and 6 for easy brazing and minimizing, e.g., corrosion. The plurality of coolant tubes 1, 2, 3, 4, 5, and 6 may be connected with the pair of plates 20 and 30 by a furnace brazing process, with part of the plurality of coolant tubes 1, 2, 3, 4, 5, and 6 inserted into the pair of plates 20 and 30.

The pair of plates 20 and 30 may be shaped as a rectangle long in a direction (Z) perpendicular to the longitudinal direction (X) of the coolant tubes 1, 2, 3, 4, 5, and 6. When the coolant tubes 1, 2, 3, 4, 5, and 6 are arranged long in a horizontal direction, the pair of plates 20 and 30 may be arranged long in a vertical direction. In contrast, when the coolant tubes 1, 2, 3, 4, 5, and 6 are arranged long in a vertical direction, the pair of plates 20 and 30 may be arranged long in a horizontal direction. The coolant flow path unit 22 of the first plate 20 and the coolant flow path unit 32 of the second plate 30 may be protruded in opposite directions thereof, while having the same size and shape.

Hereinafter, the same reference denotations are used in describing the detailed configuration of the coolant flow path units 22 and 32.

The coolant flow path units 22 and 32 may include tube connection parts to which the coolant tubes 1, 2, 3, 4, 5, and 6 are connected, and the coolant flow path units 22 and 32 may include a plurality of tube connection parts 41, 42, 43, 44, 45, and 46. The plurality of tube connection parts 41, 42, 43, 44, 45, and 46 may be formed in each of the pair of plates 20 and 30 to be spaced apart from each other. The plurality of tube connection parts 41, 42, 43, 44, 45, and 46 may be formed in parallel with each other.

The coolant flow path units 22 and 32 may include common flow path parts 48 spaced apart from the plurality of tube connection parts 41, 42, 43, 44, 45, and 46. The number of common flow path parts 48 may be smaller than the number of the plurality of tube connection parts 41, 42, 43, 44, 45, and 46.

The coolant flow path units 22 and 32 may include connection flow path parts 50 connecting the common flow path parts 48 with the plurality of tube connection parts 41, 42, 43, 44, 45, and 46.

The coolant guide 10 may be combined with the plurality of coolant tubes 1, 2, 3, 4, 5, and 6 to function as a coolant distributer for distributing a coolant to the plurality of coolant tubes 1, 2, 3, 4, 5, and 6. A coolant may be distributed to the plurality of tube connection parts 41, 42, 43, 44, 45, and 46 through the connection flow path part 50, and the distributed coolant may be distributed to the plurality of coolant tubes 1, 2, 3, 4, 5, and 6.

In the heat exchanger, a plurality of coolant guides may be connected with the plurality of coolant tubes 1, 2, 3, 4, 5, and 6. The number of coolant guides 10 and 11 may be smaller than the number of coolant tubes 1, 2, 3, 4, 5, and 6. In the heat exchanger, a pair of coolant guides 10 and 11 may be connected with the plurality of coolant tubes 1, 2, 3, 4, 5, and 6. In the heat exchanger, the two coolant guides 10 and 11 may form a single body with the plurality of coolant tubes 1, 2, 3, 4, 5, and 6. The two coolant guides 10 and 11 may have the same structure. The plurality of tube connection parts 41, 42, 43, 44, 45, and 46 of each of the two coolant guides 10 and 11 may be connected with the plurality of coolant tubes 1, 2, 3, 4, 5, and 6, respectively. One (e.g., coolant guide 10) of the two coolant guides 10 and 11 may be connected with first ends of the plurality of coolant tubes 1, 2, 3, 4, 5, and 6, and the other (e.g., coolant guide 11) of the two coolant guides 10 and 11 may be connected with second ends of the plurality of coolant tubes 1, 2, 3, 4, 5, and 6.

One (e.g., coolant guide 10) of the two coolant guides 10 and 11 may have a branch flow path for distributing a coolant to the plurality of coolant tubes 1, 2, 3, 4, 5, and 6. The other (e.g., coolant guide 11) of the two coolant guides 10 and 11 may have a merging flow path for guiding a coolant flowing through the plurality of coolant tubes 1, 2, 3, 4, 5, and 6.

A coolant may be introduced into the common flow path part 48 of one (e.g., coolant guide 10) of the two coolant guides 10 and 11, flow through the connection flow path part 50, and may be then distributed into the plurality of tube connection parts 41, 42, 43, 44, 45, and 46, and the coolant may flow through each of the plurality of coolant tubes 1, 2, 3, 4, 5, and 6.

After passing through the plurality of coolant tubes 1, 2, 3, 4, 5, and 6, the coolant may be introduced into the connection flow path part 50 through the plurality of tube connection parts 41, 42, 43, 44, 45, and 46 of the other (e.g., coolant guide 11) of the two coolant guides 10 and 11, and the coolant may be then introduced through the connection flow path part 50 into the common flow path part 48, then passing through the common flow path part 48.

In the heat exchanger, the plurality of coolant tubes 1, 2, 3, 4, 5, and 6 and the two coolant guides 10 and 11 may form one heat exchange unit. The heat exchanger may further include a fin 4, a heat transfer member, which is connected with the plurality of coolant tubes 1, 2, 3, 4, 5, and 6. A plurality of fins 49 may be connected with the plurality of coolant tubes 1, 2, 3, 4, 5, and 6. In the heat exchanger, the plurality of coolant tubes 1, 2, 3, 4, 5, and 6, the two coolant guides 10 and 11, and a plurality of fins 49 may form one heat exchange unit. The heat exchanger may include a single heat exchange unit or a plurality of heat exchange units A and B. In the case the heat exchanger includes a plurality of heat exchange units A and B, the heat exchanger may further include a heat exchange unit connector 60 connecting the plurality of heat exchange units A and B with each other.

The heat exchanger may include a front-row heat exchange unit A and a rear-row heat exchange unit B that are sequentially positioned in an air flow direction, and the front-row heat exchange unit A and the rear-row heat exchange unit B may be connected with each other via the heat exchange unit connector 60. The front-row heat exchange unit A and the rear-row heat exchange unit B may have the same structure. The heat exchange unit connector 60 may be formed of a return bend that is bent in the shape of the letter "U." The heat exchange unit connector 60 may connect the coolant flow path units 22 and 32 of one (e.g., coolant guide 11) of the two coolant guides 10 and 11 of the front-row heat exchange unit A with the coolant flow path units 22 and 32 of one (e.g., coolant guide 10) of the two coolant guides 10 and 11 of the rear-row heat exchange unit B.

Meanwhile, a worker may bring the pair of plates 20 and 30 in contact with the coolant flow path units 22 and 32, with the pair of plates 20 and 30 facing the coolant flow path units 22 and 32, while positioning part of the plurality of coolant tubes 1, 2, 3, 4, 5, and 6 inside the coolant flow path units 22 and 32 of the pair of plates 20 and 30.

The worker may join the plurality of coolant tubes 1, 2, 3, 4, 5, and 6 with the pair of plates 20 and 30 by a furnace brazing process. The furnace brazing process is performed by heating in a furnace, and the process does not require use of a flux, thus simplifying the process while providing for high-quality products.

In the heat exchanger, the plurality of coolant tubes 1, 2, 3, 4, 5, and 6 may be joined with the pair of plates 20 and 30 by the furnace brazing process. In the heat exchanger, the joining parts 24 and 34 of the pair of plates 20 and 30 may be joined by the furnace brazing process, and the pair of plates 20 and 30 may be integrally formed with the plurality of coolant tubes 1, 2, 3, 4, 5, and 6.

Figure 6:
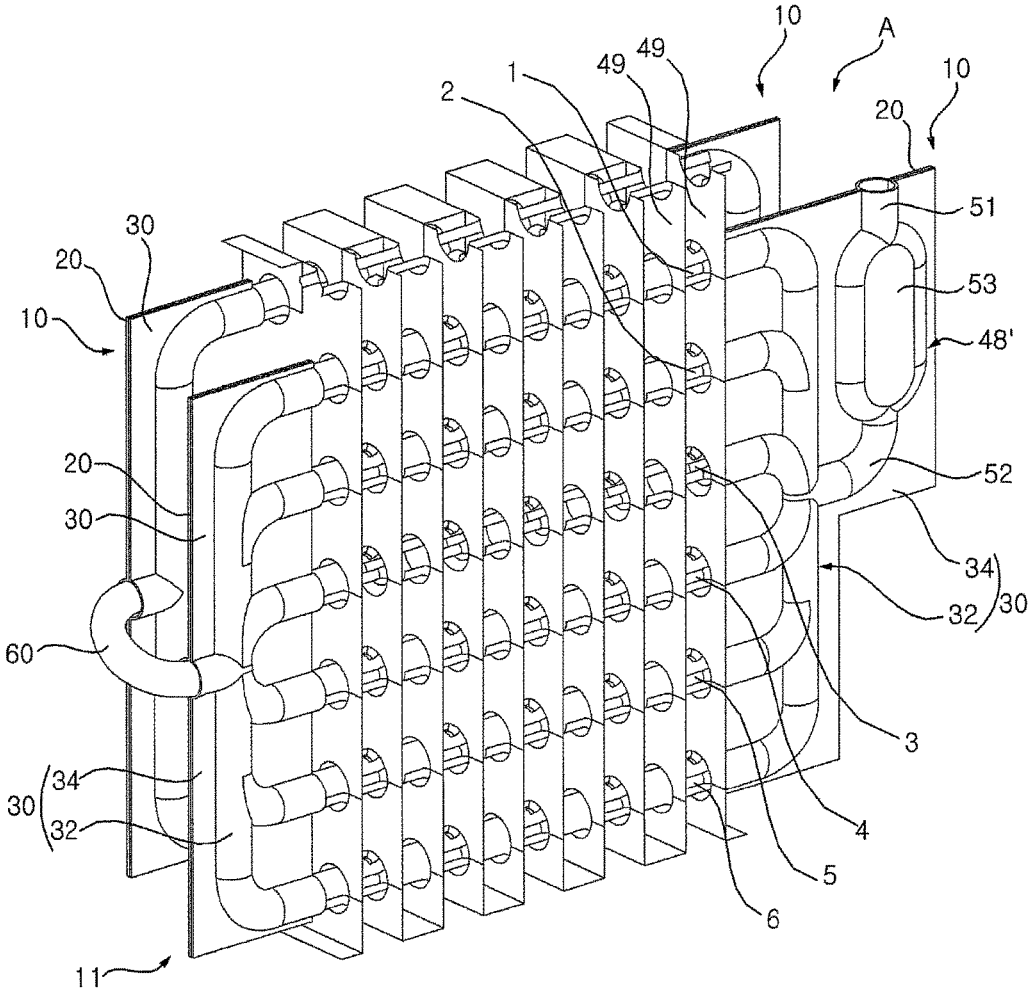
FIG. 6 is a perspective view illustrating a heat exchanger according to a second embodiment of the present invention.
Figure 7:
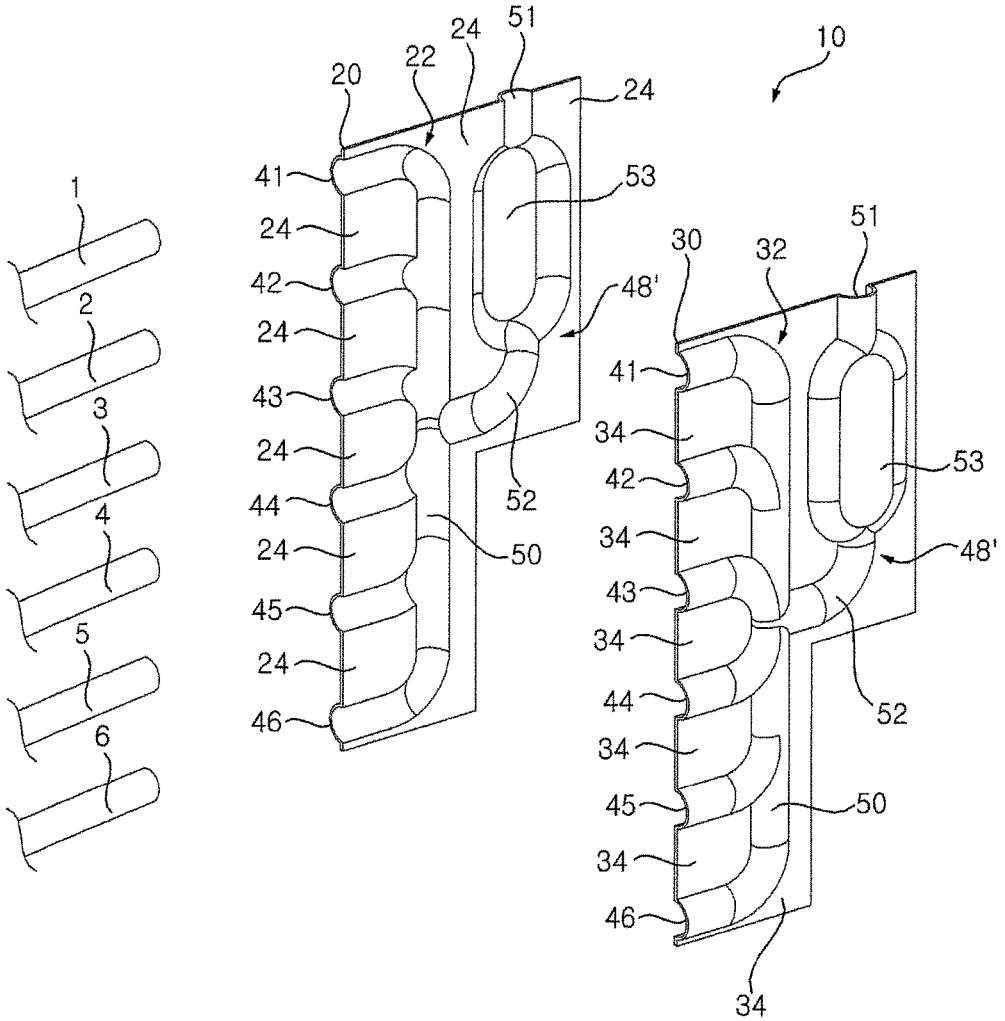
FIG. 7 is an exploded, perspective view illustrating a heat exchanger according to the second embodiment of the present invention.

FIG. 6 is a perspective view illustrating a heat exchanger according to a second embodiment of the present invention, and FIG. 7 is an exploded, perspective view illustrating the heat exchanger according to the heat exchanger according to the second embodiment of the present invention.

In the heat exchanger according to the instant embodiment, a common flow path part 48' includes first and second common flow path parts 51 and 52 spaced apart from each other and an expanded flow path part 53 connected with each of the first and second common flow path parts 51 and 52 and being larger in size than the first and second common flow path parts 51 and 52. One (e.g., first common flow path part 51) of the first and second common flow path parts 51 and 52 is spaced apart from the connection flow path part 50, and the other (e.g., second common flow path part 52) may be connected with the connection flow path part 50. Hereinafter, an example is described in which the first common flow path part 51 is spaced apart from the connection flow path part 50, and the connection flow path part 50 is connected with the second common flow path part 52.

The instant embodiment is the same or similar to the first embodiment in other configurations and operations than the common flow path part 48', and the detailed description thereof is skipped. The same reference denotations are used to refer to the same elements.

Coolant flow path units 22 and 32 of a pair of plates 20 and 30 may include a plurality of tube connection parts 41, 42, 43, 44, 45, and 46, a connection flow path part 50, an expanded flow path part 53, and a first common flow path part 51.

A coolant introduced into the first common flow path part 51 may sequentially flow through the expanded flow path part 53, the second common flow path part 52, the connection flow path part 50, and the plurality of tube connection parts 41, 42, 43, 44, 45, and 46.

A coolant introduced from the plurality of coolant tubes 1, 2, 3, 4, 5, and 6 into the plurality of tube connection parts 41, 42, 43, 44, 45, and 46 may sequentially flow through the connection flow path part 50, the second common flow path part 52, the expanded flow path part 53, and the first common flow path part 51.

In the heat exchanger according to this embodiment, a coolant may be contained in the expanded flow path part 53, and the expanded flow path part 53 may function as a receiver. The coolant guide 10 may function as a receiver for containing the coolant, as well as a coolant distributer for distributing the coolant. Accordingly, as compared with when a receiver for containing a coolant is separately installed, the heat exchanger according to this embodiment may have a more simplified structure and a reduced number of parts.

In the heat exchanger according to the present embodiment, like in the first embodiment, two coolant guides 10 and 11 may be coupled with the plurality of coolant tubes 1, 2, 3, 4, 5, and 6.

In the heat exchanger, the two coolant guides 10 and 11 each may have the plurality of tube connection parts 41, 42, 43, 44, 45, and 46, the connection flow path part 50, the first and second common flow path parts 51 and 52, and the expanded flow path part 53, and each of the two coolant guides 10 and 11 may have both a coolant distribution function and a coolant containing function.

In the heat exchanger, alternatively, one (e.g., coolant guide 10) of the two coolant guides 10 and 11 may have the plurality of tube connection parts 41, 42, 43, 44, 45, and 46, the connection flow path part 50, the first and second common flow path parts 51 and 52, and the expanded flow path part 53, while the other (e.g., coolant guide 11) of the two coolant guides 10 and 11 may have a common flow path part 48 without the expanded flow path part 53 like in the first embodiment of the present invention.

Figure 8:
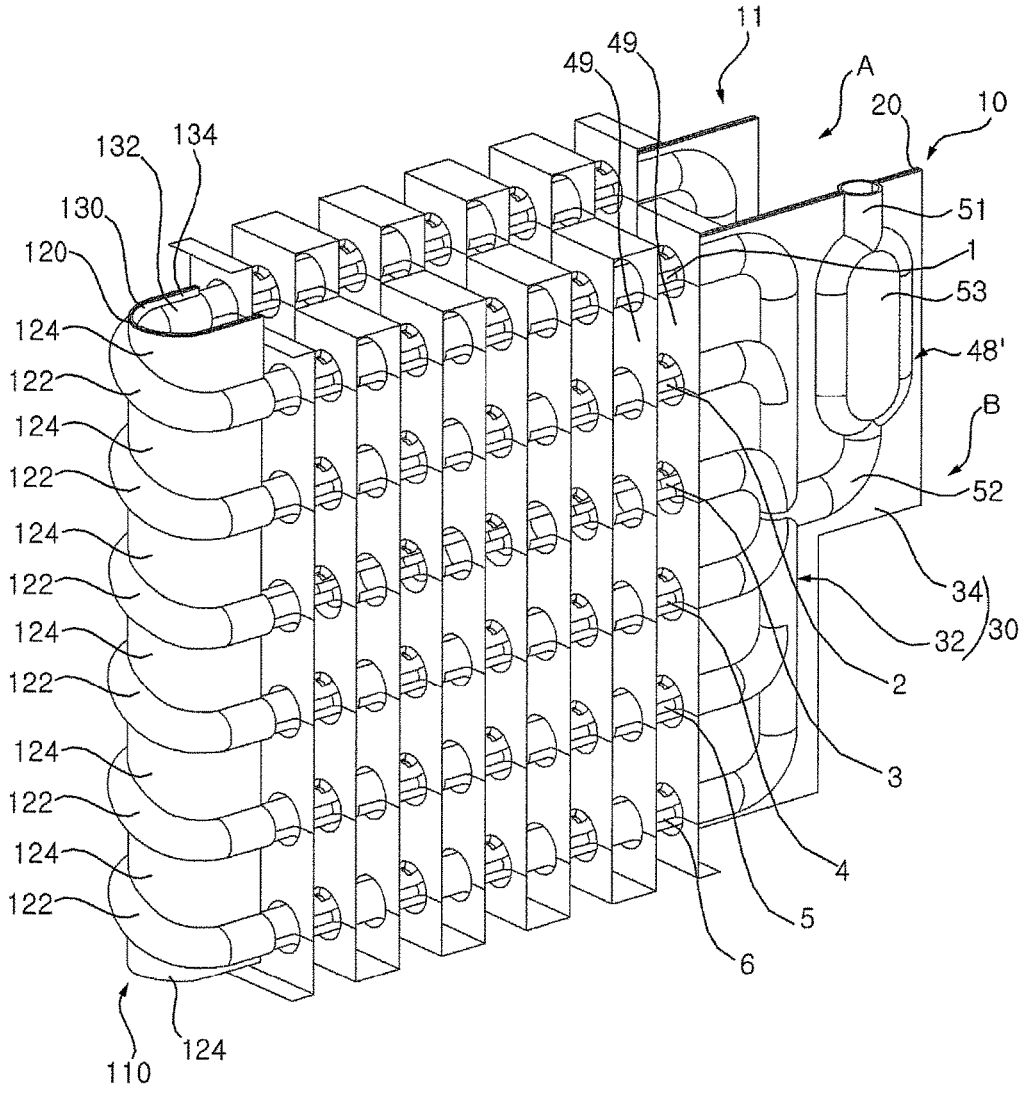
FIG. 8 is a perspective view illustrating a heat exchanger according to a third embodiment of the present invention.
Figure 9:
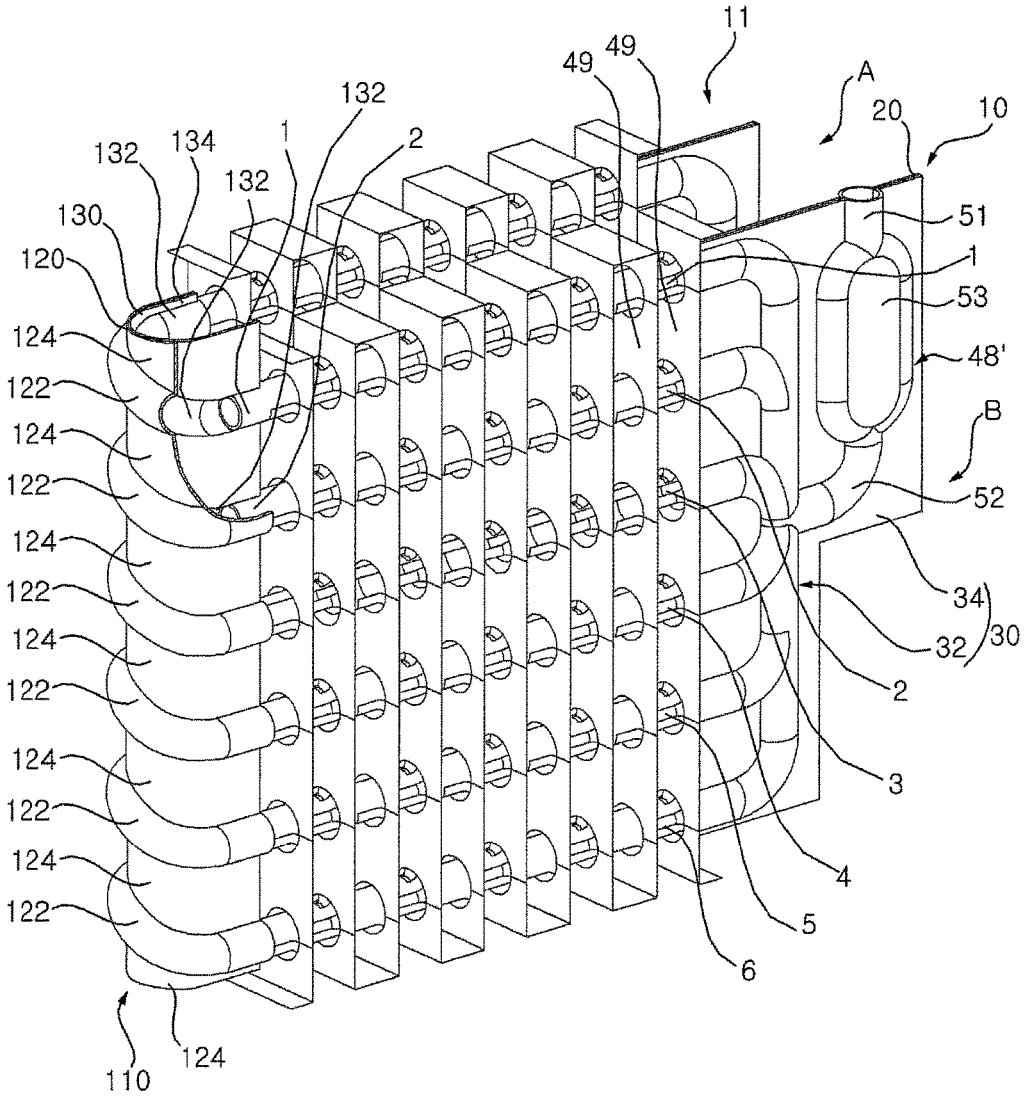
FIG. 9 is a perspective view illustrating a heat exchanger with a portion thereof cut away, according to the third embodiment of the present invention.
Figure 10:
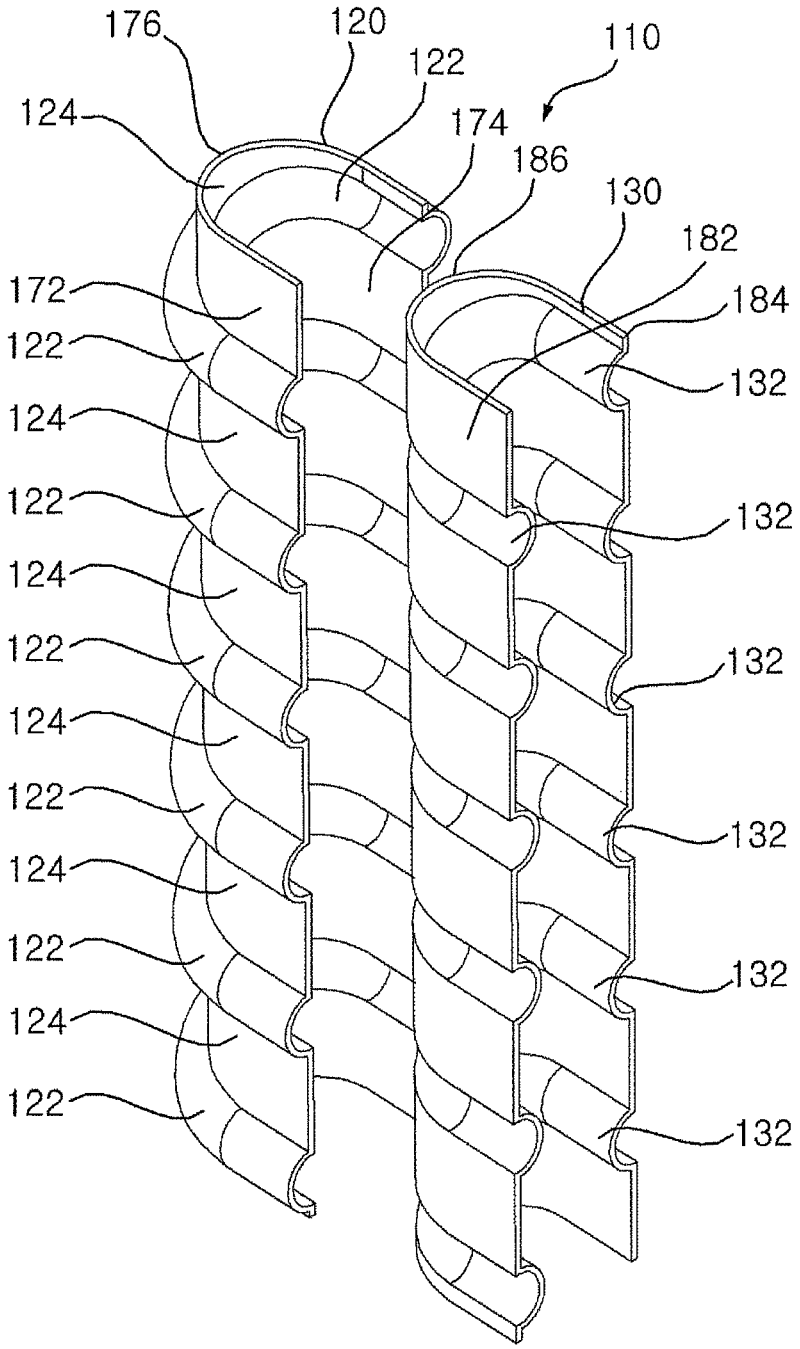
FIG. 10 is an exploded, perspective view illustrating a heat exchange unit connector of a heat exchanger according to the third embodiment of the present invention.
Figure 11:
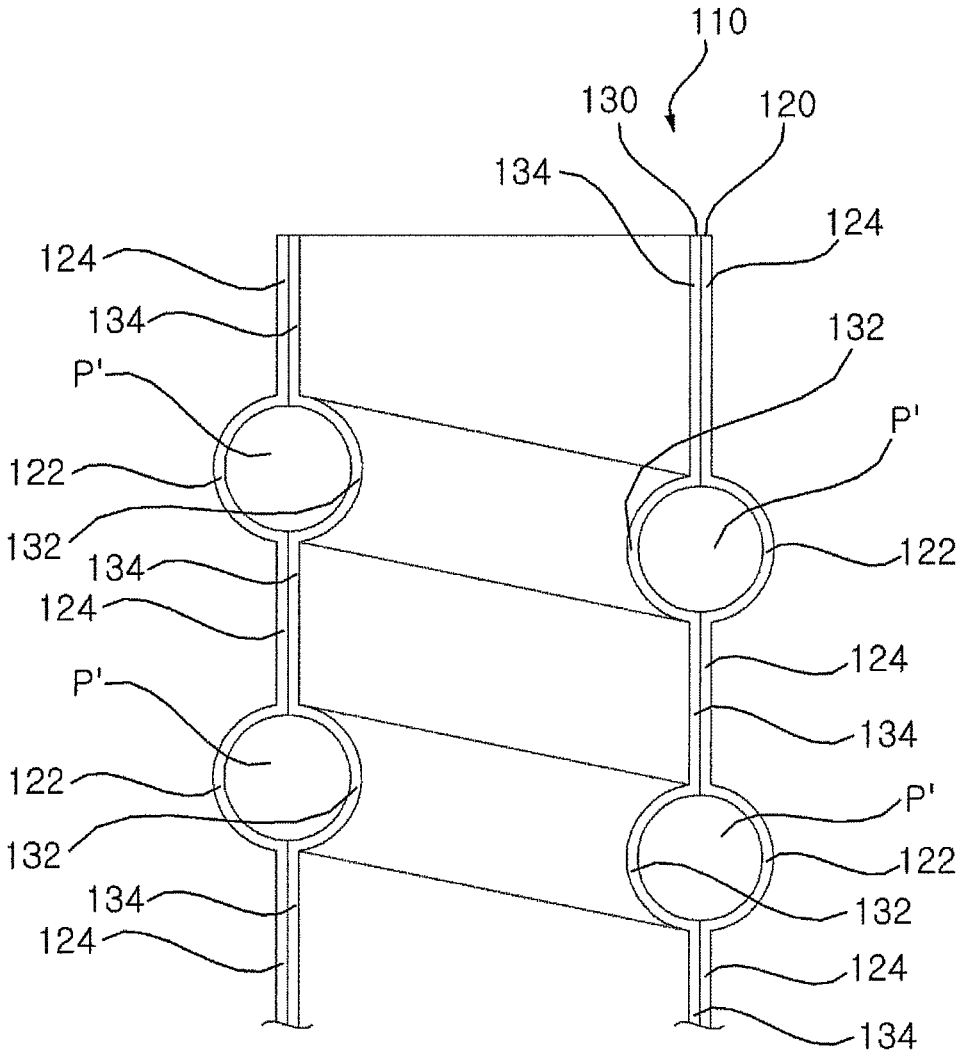
FIG. 11 is a longitudinal sectional view illustrating the heat exchange unit connector of the heat exchanger according to the third embodiment of the present invention.
Figure 12:
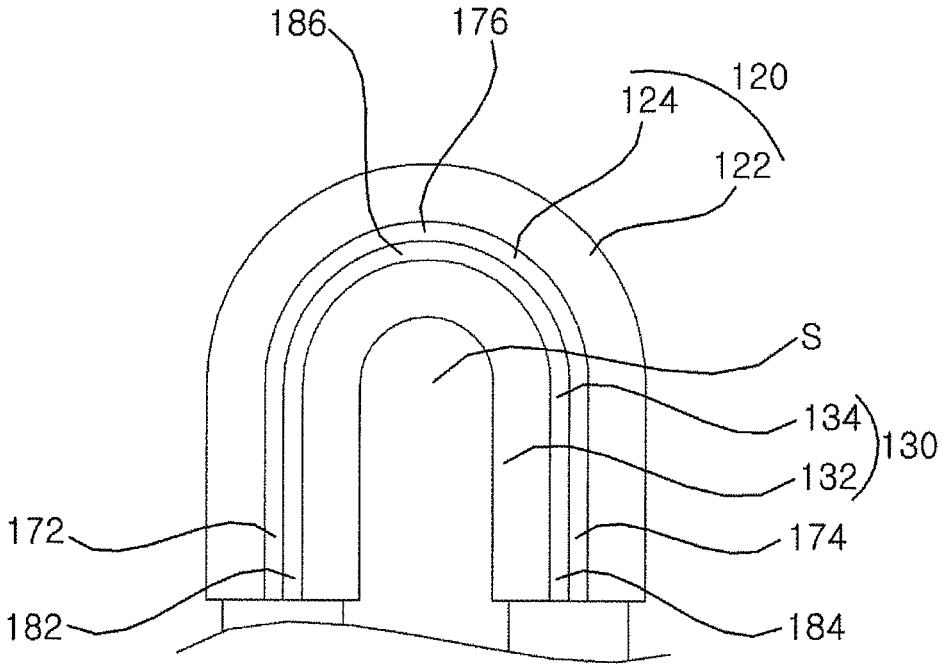
FIG. 12 is a plan view illustrating the heat exchange unit connector of the heat exchanger according to the third embodiment of the present invention.

FIG. 8 is a perspective view illustrating a heat exchanger according to a third embodiment of the present invention. FIG. 9 is a perspective view illustrating a heat exchanger with a portion thereof cut away, according to the third embodiment of the present invention. FIG. 10 is an exploded, perspective view illustrating a heat exchange unit connector of a heat exchanger according to the third embodiment of the present invention. FIG. 11 is a longitudinal sectional view illustrating the heat exchange unit connector of the heat exchanger according to the third embodiment of the present invention. FIG. 12 is a plan view illustrating the heat exchange unit connector of the heat exchanger according to the third embodiment of the present invention.

According to the instant embodiment, the heat exchanger includes a front-row heat exchange unit A; a rear-row heat exchange unit B through which air having passed through the front-row heat exchange unit A passes; and a heat exchange unit connector 110 having a coolant flow path P' through which the front-row heat exchange unit A and the rear-row heat exchange unit B communicate with each other.

The front-row heat exchange unit A and the rear-row heat exchange unit B each may include a plurality of coolant tubes 1, 2, 3, 4, 5, and 6. In the heat exchanger, after passing through the plurality of coolant tubes 1, 2, 3, 4, 5, and 6 of the front-row heat exchange unit A, a coolant may be guided through the heat exchange unit connector 110 into the plurality of coolant tubes 1, 2, 3, 4, 5, and 6 of the rear-row heat exchange unit B. In the heat exchanger, after passing through the plurality of coolant tubes 1, 2, 3, 4, 5, and 6 of the rear-row heat exchange unit B, a coolant may be guided through the heat exchange unit connector 110 into the plurality of coolant tubes 1, 2, 3, 4, 5, and 6 of the front-row heat exchange unit A.

In the heat exchange unit connector 110, the coolant flow path P' is formed between two connectors 120 and 130 positioned opposite each other, and a coolant may pass between the two connectors 120 and 130. The two connectors 120 and 130 may be a coolant flow path forming member forming the coolant flow path P' through which a coolant passes, or the two connectors 120 and 130 may be combined to form the coolant flow path F. A single coolant flow path P' may be formed between the pair of connectors 120 and 130. A plurality of coolant flow paths P' may be formed between the pair of connectors 120 and 130. In the heat exchanger, a plurality of coolant flow paths P' may be formed between the pair of connectors 120 and 130, and one of the plurality of coolant flow paths P' may connect a coolant tube of the front-row heat exchange unit A with a coolant tube of the rear-row heat exchange unit B. The front-row heat exchange unit A may be the same in the number of coolant tubes as the rear-row heat exchange unit B, and the number of coolant flow paths P' may the same as the number of coolant tubes of the front-row heat exchange unit A and the number of coolant tubes of the rear-row heat exchange unit B. As a plurality of coolant flow paths P' are formed by the pair of connectors 120 and 130, the heat exchanger may enjoy a more simplified assembling process as compared with when a plurality of return bends are installed instead of the pair of connectors 120 and 130. In particular, when at least three or more coolant flow paths P' are formed by the pair of connectors 120 and 130, the number of parts may be further reduced as compared with when three or more return bends are installed instead of the pair of connectors 120 and 130.

The heat exchange unit connector 110 may include an outer connector 120 and an inner connector 130 that is positioned opposite the outer connector 120 inside the outer connector 120. The outer connector 120 and the inner connector 130 may be formed so that coolant flow path units 122 and 132 forming the coolant flow path P' face each other. The outer connector 120 and the inner connector 130 respectively include joining parts 124 and 134 that come in surface contact with each other, in addition to the coolant flow path units 122 and 132. The joining part 124 of the outer connector 120 may face the joining part 134 of the inner connector 130. The outer connector 120 may include a plurality of joining parts 124, and the inner connector 130 may include a plurality of joining parts 134. The plurality of joining parts 124 (or 134) of the outer connector 120 (or inner connector 130) may be spaced apart from each other.

The plurality of coolant tubes 1, 2, 3, 4, 5, and 6 may have the same configuration as those of the first embodiment. The coolant tubes 1, 2, 3, 4, 5, and 6 may be shaped as a hollow straight pipe. The coolant tubes 1, 2, 3, 4, 5, and 6 may be spaced apart from each other in a direction perpendicular to their longitudinal direction, and the coolant tubes 1, 2, 3, 4, 5, and 6 may be connected in parallel with each other to the heat exchange unit connector 110. The plurality of coolant tubes 1, 2, 3, 4, 5, and 6 may be connected with the heat exchange unit connector 110, and the plurality of coolant tubes 1, 2, 3, 4, 5, and 6, together with the heat exchange unit connector 110 may form a single body.

The plurality of coolant tubes 1, 2, 3, 4, 5, and 6 may be formed of aluminum as in the first embodiment. An end of each coolant tube 1, 2, 3, 4, 5, and 6 may be inserted into a space between the outer connector 120 and the inner connector 130. An end of each coolant tube 1, 2, 3, 4, 5, and 6 may come in surface contact with each of the outer connector 120 and the inner connector 130. An end of each coolant tube 1, 2, 3, 4, 5, and 6 may be inserted into the coolant flow path unit 120 of the pair of connectors 120 and 130 and the coolant flow path unit 132 of the inner connector 130.

A first portion of each of the plurality of coolant tubes 1, 2, 3, 4, 5, and 6 may be inserted into a space between the outer connector 120 and the inner connector 130, and a portion of the first portion may be inserted into the coolant flow path unit 122 of outer connector 120, and the remainder of the first portion may be inserted into the coolant flow path unit 132 of the inner connector 130. Part of the coolant tubes 1, 2, 3, 4, 5, and 6 inserted into the heat exchange unit connector 110 may, partially in its partial outer circumferential surface, come in surface contact with the coolant flow path unit 122 of the outer connector 120. The part of the coolant tubes 1, 2, 3, 4, 5, and 6 inserted into the heat exchange unit connector 110 may, in its remaining outer circumferential surface, come in surface contact with the coolant flow path unit 132 of the inner connector 130.

The heat exchanger according to the instant embodiment may be the same or similar to the first or second embodiment in other configurations and operations than the heat exchange unit connector 110, and the detailed description thereof is skipped. The same reference denotations are used to refer to the same elements.

The coolant flow path P' formed by the outer connector 120 and the inner connector 130 may be a return flow path guiding a coolant passing through the coolant tubes of the front-row heat exchange unit A to the coolant tubes of the rear-row heat exchange unit B or guiding a coolant passing through the coolant tubes of the rear-row heat exchange unit B to the coolant tubes of the front-row heat exchange unit A.

The outer connector 120 and the inner connector 130 may be shaped as a rectangle long in a direction (Z) perpendicular to the longitudinal direction (X) of the coolant tubes 1, 2, 3, 4, 5, and 6. The outer connector 120 and the inner connector 130 may form a plurality of coolant flow paths P'. A plurality of coolant tubes 1, 2, 3, 4, 5, and 6 may be connected with the outer connector 120, and a plurality of coolant tubes 1, 2, 3, 4, 5, and 6 may be connected with the inner connector 130.

The coolant flow path units 122 and 132 may be convexly protruded between a plurality of joining parts 124 and 134 as shown in FIGS. 10 to 12. The coolant flow path unit 122 of the outer connector 120 and the coolant flow path unit 132 of the inner connector 130 may be convexly protruded in opposite directions thereof. The coolant flow path unit 122 of the outer connector 120 may be convexly protruded towards an outer side of the heat exchange unit connector 110. The coolant flow path unit 132 of the inner connector 130 may be convexly protruded towards an inner side of the heat exchange unit connector 110.

A portion of the coolant flow path unit 122 of the outer connector 120 may be shaped to surround a partial outer circumferential surface of the part of the coolant tube 1, 2, 3, 4, 5, or 6 inserted into the heat exchange unit connector 110. A portion of the coolant flow path unit 132 of the inner connector 130 may be shaped to surround the remaining outer circumferential surface of the part of the coolant tube 1, 2, 3, 4, 5, or 6 inserted into the heat exchange unit connector 110. The coolant flow path unit 122 of the outer connector 120 may include a space that is part of the coolant flow path P', and the coolant flow path unit 132 of the inner connector 130 may include a space that is the remainder of the coolant flow path P'. The cross section of the coolant flow path units 122 and 132 may be semi-circular in shape. The coolant flow path unit 122 of the outer connector 120 and the coolant flow path unit 132 of the inner connector 130, when the outer connector 120 is joined with the inner connector 130, form a circular shape in cross section, and the coolant flow path unit 122 and the coolant flow path unit 132 may be combined to form a return bend part guiding a coolant. The outer connector 120 and the inner connector 130 may have a plurality of return bend parts, and the plurality of return bend parts may remain connected with the joining parts 124 and 134.

The outer connector 120 and the inner connector 130 may be brazed with each of the plurality of coolant tubes 1, 2, 3, 4, 5, and 6. The outer connector 120 and the inner connector 130 may be formed of the same material (e.g., aluminum) as the coolant tubes 1, 2, 3, 4, 5, and 6. In the heat exchanger, the plurality of coolant tubes 1, 2, 3, 4, 5, and 6 may be connected with the outer connector 120 and the inner connector 130 by a furnace brazing process, with the plurality of coolant tubes 1, 2, 3, 4, 5, and 6 partially inserted into the outer connector 120 and the inner connector 130.

The outer connector 120 and the inner connector 130 each may include a plurality of flat plates facing each other and a curved plate connecting the pair of flat plates with each other. The curved plates of the outer connector 120 and the inner connector 130 may be opened in an opposite direction thereof. The coolant flow path unit 122 or 132 may be continuously formed on one of the pair of flat plates, the curved plate, and the other of the pair of flat plates.

The outer connector 120 may be formed to be larger than the inner connector 130. The outer connector 120 may be formed to surround the outer surface of the inner connector 130. The outer connector 120 may include a pair of outer flat plates 172 and 174 that are spaced apart from each other and positioned opposite each other and an outer curved plate 176 connecting the pair of outer flat plates 172 and 174 with each other. The outer curved plate 176 of the outer connector 120 may be opened from its opposite surface. The outer connector 120 may have a space S for accommodating the inner connector 130 formed between the pair of outer flat plates 172 and 174 and the outer curved plate 176. The coolant flow path unit 122 of the outer connector 120 may be continuously formed on one (e.g., outer flat plate 172) of the pair of outer flat plates 172 and 174, the outer curved plate 176, and the other (e.g., outer flat plate 174) of the pair of outer flat plates 172 and 174.

The inner connector 130 may be formed to be smaller than the outer connector 120. The inner connector 130 may include a pair of inner flat plates 182 and 184 that are spaced apart from each other and positioned opposite each other and an inner curved plate 186 connecting the pair of inner flat plates 182 and 184 with each other. The inner curved plate 186 of the inner connector 130 may be opened from its opposite surface. The pair of inner flat plates 182 and 184 may be positioned between the pair of outer flat plates 172 and 174. One (e.g., inner flat plate 182) of the pair of inner flat plates 182 and 184 may partially come in surface contact with one (e.g., outer flat plate 172) of the pair of outer flat plates 172 and 174 while facing the outer flat plate 172, and the other (e.g., inner flat plate 184) of the pair of inner flat plates 182 and 184 may partially come in surface contact with the other (e.g., outer flat plate 174) of the pair of outer flat plates 172 and 174 while facing the outer flat plate 174. The inner curved plate 186 may be smaller in size than the outer curved plate 176, and the inner curved plate 186 may partially come in surface contact with the outer curved plate 176 while facing the outer curved plate 176.

The coolant flow path unit 132 of the inner connector 130 may be continuously formed on one (e.g., inner flat plate 182) of the pair of inner flat plates 182 and 184, the inner curved plate 186, and the other (e.g., inner flat plate 184) of the pair of inner flat plates 182 and 184.

A worker may bring the outer connector 120 in contact with the inner connector 130 so that the coolant flow path unit 122 of the outer connector 120 faces the coolant flow path unit 132 of the inner connector 130, when assembling the heat exchanger. While bringing the outer connector 120 in contact with the inner connector 130, the worker may position the respective portions of the plurality of coolant tubes 1, 2, 3, 4, 5, and 6 of the front-row heat exchange unit A between the coolant flow path unit 122 of the outer connector 120 and the coolant flow path unit 132 of the inner connector 130 and the respective portions of the plurality of coolant tubes 1, 2, 3, 4, 5, and 6 of the rear-row heat exchange unit B between the coolant flow path unit 122 of the outer connector 120 and the coolant flow path unit 132 of the inner connector 130.

The worker may join the front-row heat exchange unit A and the rear-row heat exchange unit B with the outer connector 120 and the inner connector 130 by a furnace brazing process.

In the heat exchanger, the joining part 124 of the outer connector 120 may be joined with the joining part 134 of the inner connector 130 by a furnace brazing process. Each of the plurality of coolant tubes 1, 2, 3, 4, 5, and 6 of the front-row heat exchange unit A and each of the plurality of coolant tubes 1, 2, 3, 4, 5, and 6 of the rear-row heat exchange unit B may be joined with the outer connector 120 and the inner connector 130, and the outer connector 120 and the inner connector 130, together with the front-row heat exchange unit A and the rear-row heat exchange unit B, may form a single body.

Figure 13:
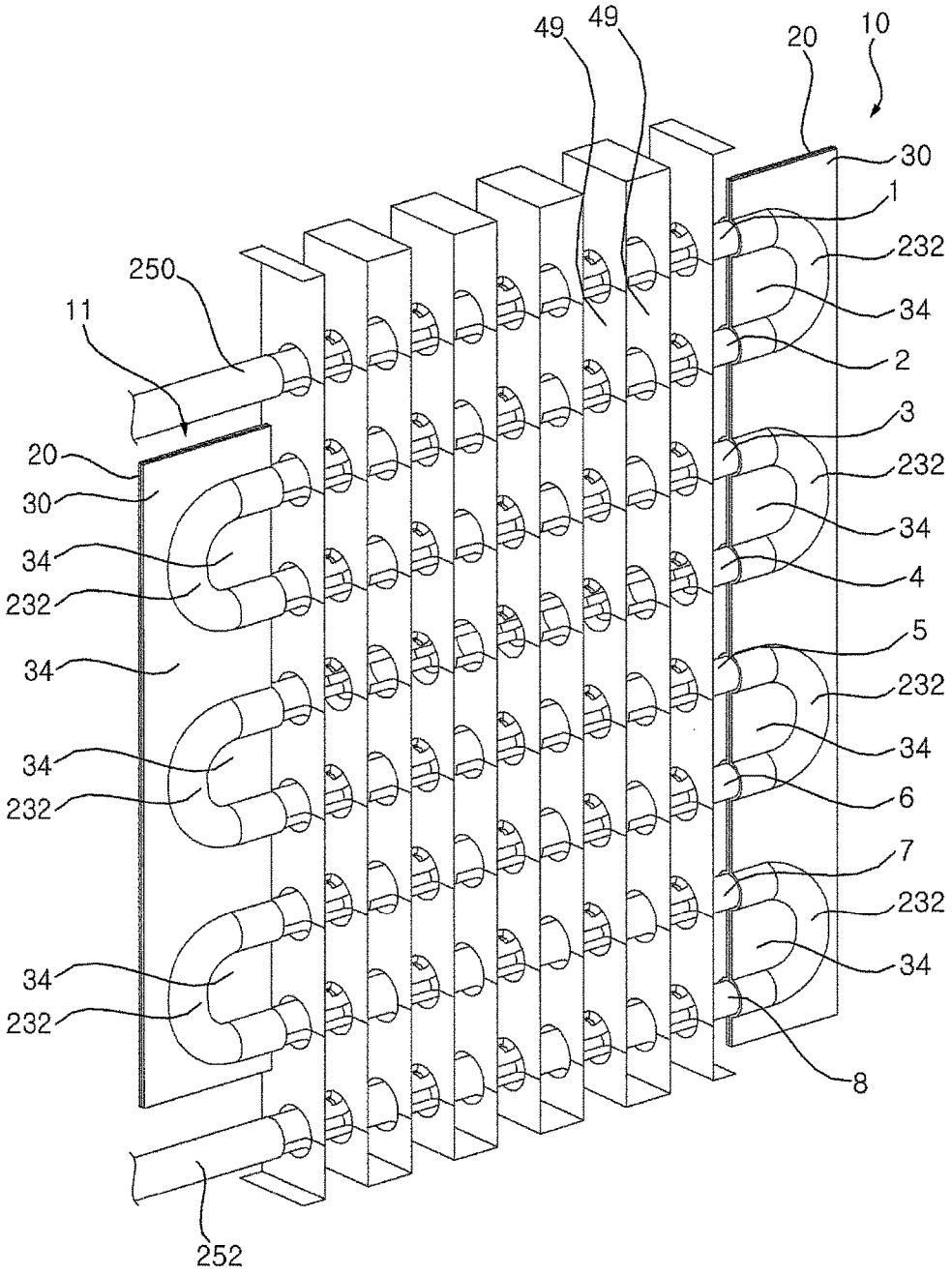
FIG. 13 is a perspective view illustrating a heat exchanger according to a fourth embodiment of the present invention.
Figure 14:
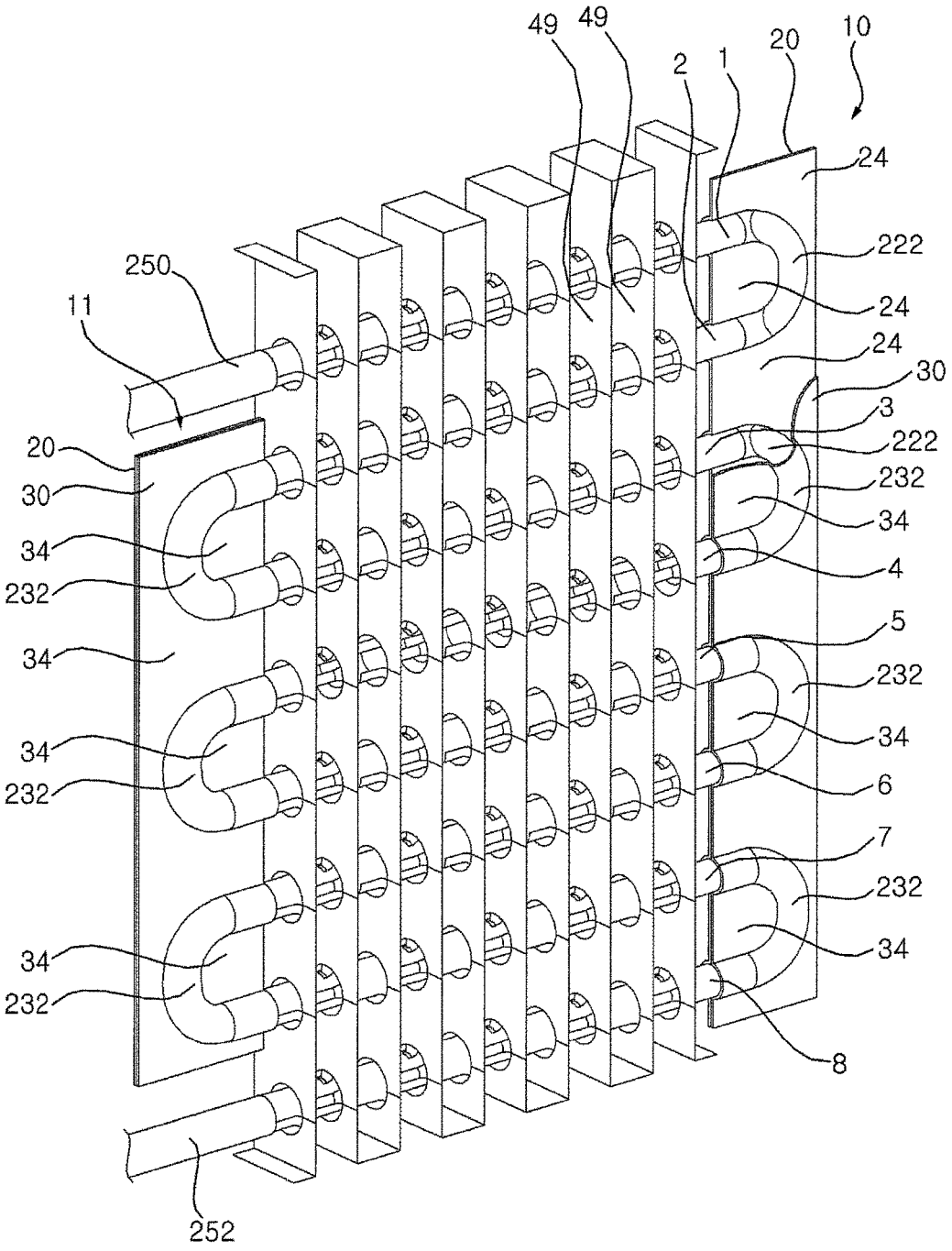
FIG. 14 is a perspective view illustrating the heat exchanger with a portion thereof cut away, according to the fourth embodiment of the present invention.
Figure 15:
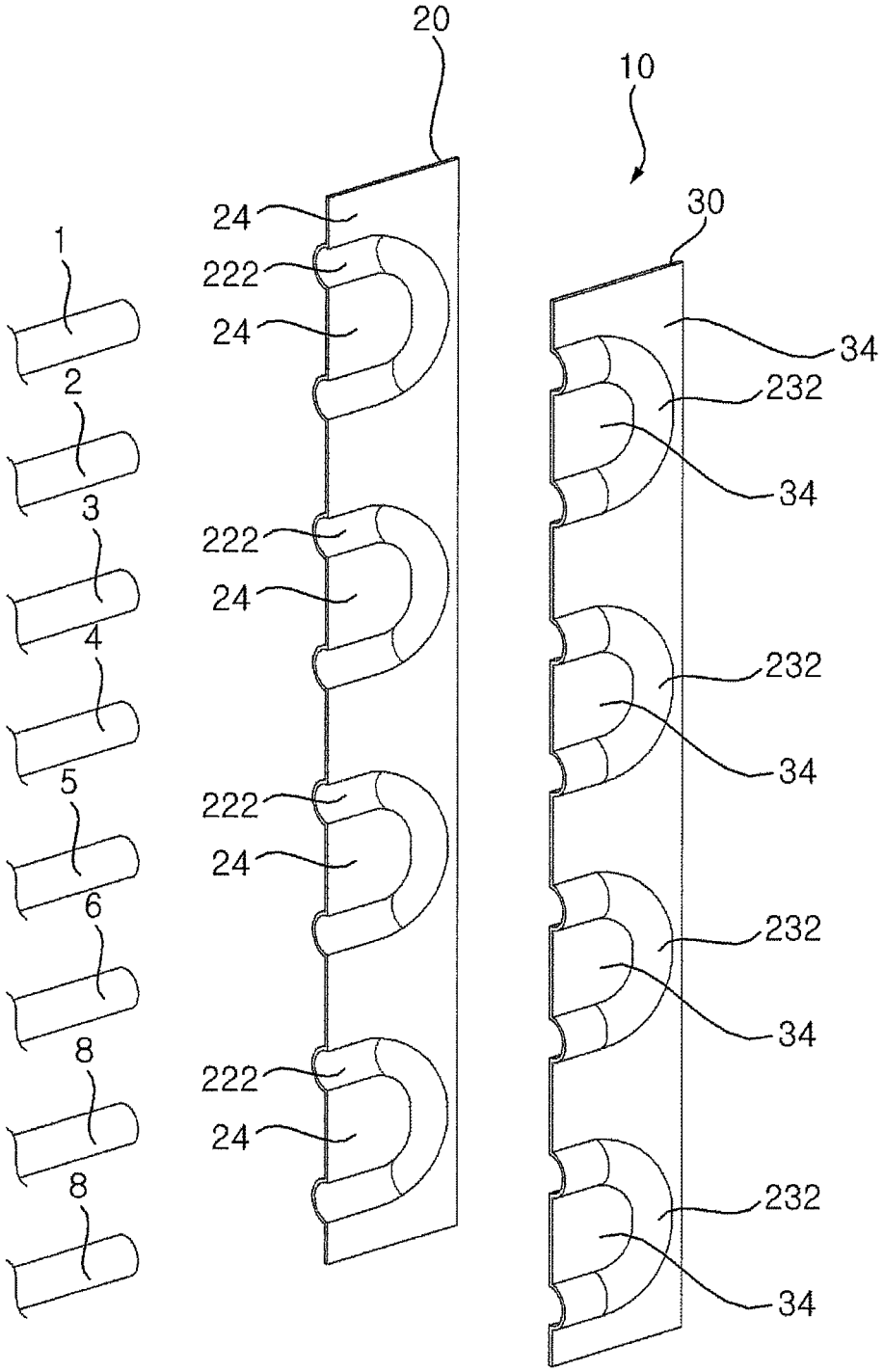
FIG. 15 is an exploded, perspective view illustrating a heat exchanger according to the second embodiment of the present invention.

FIG. 13 is a perspective view illustrating a heat exchanger according to a fourth embodiment of the present invention. FIG. 14 is a perspective view illustrating the heat exchanger with a portion thereof cut away, according to the fourth embodiment of the present invention. FIG. 15 is an exploded, perspective view illustrating a heat exchanger according to the second embodiment of the present invention.

In the instant embodiment, the heat exchanger includes a plurality of coolant tubes 1, 2, 3, 4, 5, 6, 7, and 8 and a coolant guide 10. The coolant guide 10 includes a pair of plates 20 and 30. The pair of plates 20 and 30 have coolant flow path units formed opposite each other to form a coolant flow path. The pair of plates 20 and 30, respectively, further include joining parts 24 and 34 that come in surface contact with each other. The coolant flow path units are return flow path parts 222 and 232 connecting two coolant tubes with each other. Each of the pair of plates 20 and 30 may include a plurality of return flow path parts 222 and 232. The return flow path part 222 of the first plate 20 may be formed to be opposite the return flow path part 232 of the second plate 30, and the return flow path parts 222 and 232 may be convexly protruded in opposite directions thereof. The return flow path parts 222 and 232 each may be formed in the shape of the letter "U." The plurality of return flow path parts 222 and 232 may be spaced apart from each other in a longitudinal direction of the pair of plates 20 and 30.

The heat exchanger according to the present embodiment have the same or similar configurations and operations to that according to the first embodiment except that the coolant flow path unit includes the plurality of return flow path parts 222 and 232, and the detailed description thereof is skipped. The same reference denotations are used to refer to the same elements.

Two of the coolant tubes 1, 2, 3, 4, 5, 6, 7, and 8 may communicate with each other through a pair of return flow path parts 222 and 232. For example, a coolant guide 10 allowing eight coolant tubes 1, 2, 3, 4, 5, 6, 7, and 8 to communicate with each other may include four pairs of return flow path parts 222 and 232, and a coolant guide 10 allowing six coolant tubes 2, 3, 4, 5, 6, and 7 to communicate with each other may include three pairs of return flow path parts 222 and 232.

The heat exchanger may include an inlet pipe 250 connected with any one (e.g., coolant tube 1) of the plurality of coolant tubes 1, 2, 3, 4, 5, 6, 7, and 8 to guide a coolant to any one (e.g., coolant tube 1) of the plurality of coolant tubes 1, 2, 3, 4, 5, 6, 7, and 8. The heat exchanger may include an outlet pipe 252 connected with another (e.g., coolant tube 8) of the plurality of coolant tubes 1, 2, 3, 4, 5, 6, 7, and 8. In the heat exchanger, two coolant guides 10 and 11 may be connected with the plurality of coolant tubes 1, 2, 3, 4, 5, 6, 7, and 8. In the case two coolant guides 10 and 11 are connected with the plurality of coolant tubes 1, 2, 3, 4, 5, 6, 7, and 8, the number of return flow path parts 222 and 232 formed in one (e.g., coolant guide 10) of the two coolant guides 10 and 11 may be larger than the number of return flow path parts 222 and 232 formed in the other (e.g., coolant guide 11) of the two coolant guides 10 and 11.

In the heat exchanger according to this embodiment, the plurality of return flow path parts 222 and 232 may form a plurality of return bend parts, and the plurality of return bend parts may remain connected with the joining parts 24 and 34.

The present invention is not limited to the above-described embodiments, and various changes may be made thereto without departing from the scope of the invention.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a plurality of coolant tubes; and a coolant guide having a coolant flow path through which the plurality of coolant tubes communicate with each other, wherein the coolant guide includes a pair of plates facing each other, wherein each of the pair of plates including:

a coolant flow path unit, the coolant flow path unit of a first plate of the pair of plates mating with the coolant flow path unit of a second plate of the pair of plates, to form the coolant flow path; and a joining part, the joining part of the first plate of the pair of plates coming into surface contact with the joining part of the second plate of the pair of plates, wherein the coolant flow path unit including:

a plurality of tube connection parts to which the coolant tubes are connected, a common flow path part spaced from the plurality of tube connection parts, and a connection flow path part that connects the plurality of tube connection parts to the common flow path part, wherein the second plate is formed in a symmetrical shape with respect to the first plate, wherein the plurality of tube connection parts, the common flow path part, and the connection flow path part of the first plate convexly protrude respectively in opposite directions to the plurality of tube connection parts, the common flow path part, and the connection flow path part of the second plate, wherein the common flow path part includes a first common flow path part and a second common flow path part spaced from the first common flow path part, and an expanded flow path part connected with each of the first common flow path part and the second common flow path part, the expanded flow path part being larger in size than the first common flow path part and the second common flow path part, and wherein the connection flow path part is connected to the second common flow path part.

2. The heat exchanger of claim 1, wherein an end of each of the plurality of coolant tubes is provided in a space between two of the coolant flow path units.

3. The heat exchanger of claim 1, wherein the coolant flow path units are convexly protruded between two of the plurality of joining parts.

4. The heat exchanger of claim 3, wherein one of the coolant flow path units separates two of the plurality of joining parts.

5. The heat exchanger of claim 1, wherein the pair of plates are shaped as a rectangle that is long in a direction perpendicular to a longitudinal direction of the coolant tubes.

6. The heat exchanger of claim 1, wherein the plates and the plurality of coolant tubes are formed of aluminum.

7. A heat exchanger, comprising:

a plurality of coolant tubes; and a coolant guide having a coolant flow path through which the plurality of coolant tubes communicate, wherein the coolant guide includes a first plate and a second plate facing the first plate, wherein the first plate including:

a coolant flow path unit mating with the coolant flow path unit of the second plate to form the coolant flow path, and a joining part having surface contact with a joining part of the second plate, wherein the coolant flow path unit including:

a plurality of tube connection parts coupled to the coolant tubes, a common flow path part spaced from the plurality of tube connection parts, and a connection flow path part that couples the plurality of tube connection parts to the common flow path part, wherein the second plate is formed in a symmetrical shape with respect to the first plate, wherein the plurality of tube connection parts, the common flow path part, and the connection flow path part of the first plate convexly protrude respectively in opposite directions to the plurality of tube connection parts, the common flow path part, and the connection flow path part of the second plate, wherein the common flow path part includes a first common flow path part and a second common flow path part spaced from the first common flow path part, and an expanded flow path part connected with each of the first common flow path part and the second common flow path part, the expanded flow path part being larger in size than the first common flow path part and the second common flow path part, and wherein the connection flow path part is connected to the second common flow path part.

8. The heat exchanger of claim 7, wherein the coolant flow path units are convexly protruded between two of the joining parts.

9. The heat exchanger of claim 7, wherein the first and second plates and the plurality of coolant tubes are formed of aluminum.

* * * * *